US010260204B2

(12) United States Patent
Swisshelm

(10) Patent No.: US 10,260,204 B2
(45) Date of Patent: Apr. 16, 2019

(54) BERM ROLLER

(71) Applicant: Kokosing Construction Company, Inc., Westerville, OH (US)

(72) Inventor: Tom Swisshelm, Wooster, OH (US)

(73) Assignee: KOKOSING CONSTRUCTION COMPANY, INC., Westerville, OH (US)

( * ) Notice: Subject to any disclaimer, the term of this patent is extended or adjusted under 35 U.S.C. 154(b) by 0 days.

(21) Appl. No.: 15/868,333

(22) Filed: Jan. 11, 2018

(65) Prior Publication Data

US 2018/0202115 A1 Jul. 19, 2018

Related U.S. Application Data

(60) Provisional application No. 62/445,016, filed on Jan. 11, 2017.

(51) Int. Cl.

| | |
|---|---|
| ***E01C 19/00*** | (2006.01) |
| ***E01C 19/26*** | (2006.01) |
| ***E01C 19/23*** | (2006.01) |
| ***E01C 19/27*** | (2006.01) |

(52) U.S. Cl.

CPC ..... *E01C 19/268* (2013.01); *E01C 19/236* (2013.01); *E01C 19/26* (2013.01); *E01C 19/266* (2013.01); *E01C 19/27* (2013.01)

(58) Field of Classification Search

CPC ..... E01C 19/26; E01C 19/27; E01C 19/236; E01C 19/268; E01C 19/266; E01C 19/0268

USPC ..... 404/117, 122, 127, 128, 75, 104

See application file for complete search history.

(56) References Cited

U.S. PATENT DOCUMENTS

| | | | | | |
|---|---|---|---|---|---|
| 2,407,965 | A * | 9/1946 | Smith | E01C 19/27 | 267/255 |
| 3,072,025 | A * | 1/1963 | Cronin | E01C 19/268 | 404/127 |
| 3,146,686 | A * | 9/1964 | Grace | E01C 19/266 | 172/456 |
| 3,662,658 | A * | 5/1972 | Berrange | E02D 3/026 | 404/117 |
| 4,702,644 | A * | 10/1987 | Cioffi | E01C 19/266 | 404/128 |
| 5,304,013 | A * | 4/1994 | Parsons | E01C 19/266 | 404/127 |
| 5,395,182 | A * | 3/1995 | Rossburger | E01C 19/27 | 404/122 |
| 6,612,774 | B1 * | 9/2003 | Dulin | E01C 19/266 | 404/104 |

(Continued)

*Primary Examiner* — Raymond W Addie
(74) *Attorney, Agent, or Firm* — Calfee, Halter & Griswold LLP

(57) ABSTRACT

An attachment roller that attaches to a vehicle includes a main body, a plurality of rolling members, and at least one attachment arm. The rolling members are attached to the main body such that movement of the vehicle causes the rolling members to rotate and move the attachment roller. The at least one attachment arm is attached to the vehicle and the main body of the attachment roller. When the attachment roller is attached to the vehicle by the at least one attachment arm, the attachment roller has a path of travel that is not aligned on or within and is substantially parallel to a path of travel of the vehicle.

20 Claims, 6 Drawing Sheets

(56) References Cited

U.S. PATENT DOCUMENTS 7,089,955 B1 * 8/2006 Komro, Sr. ..... B60R 15/00
137/301
8,246,271 B2 * 8/2012 Verhoff ..... E01C 19/268
404/117

* cited by examiner

BERM ROLLER

CROSS REFERENCE TO RELATED APPLICATIONS

This application claims priority to U.S. Provisional Patent Application No. 62/445,016, filed on Jan. 11, 2017 and titled "Berm Roller," which is incorporated herein by reference in its entirety.

BACKGROUND

Motor vehicles are a major means of transportation that people use every day, and, because motor vehicles are used every day, the roads on which motor vehicles travel undergo wear and tear. In addition, roads often experience various types of weather conditions that affect their durability. As a result, construction is often performed on the roads in order to keep the roads in a suitable condition to support the transportation of motor vehicles.

One form of construction is paving of the roads. That is, a new layer of material (e.g., asphalt, concrete, etc.) is placed on the road. After a new layer of material is placed on the road, the new layer of material must be adequately compacted such that road has a substantially level surface. In addition, the berm (i.e., the path adjacent to the road) is often paved during construction (with a paving material, such as, for example, asphalt, recycled asphalt, berm aggregate, or any other suitable material for covering the berm) in order to provide a space adjacent to the road for vehicles to stop on or traverse if needed. The berm may also be unpaved, such that a lip exists at the edge of the road. A road 100 and berm 102*a*, 102*b* are illustrated below in FIGS. 1 and 1A-1B, in which a first berm portion 102*a* has been paved, and a second berm portion 102*b* is unpaved.

After the new material is placed on the road and/or the berm, the new material is often compacted in order to create a substantially flat surface (and, in some instances, as shown in FIG. 1A, the berm may have a substantially flat inclined surface that inclines from the ground surface 104 to the edge 106 of the road 100). The road 100 and/or berm 102*a*, 102*b* may be compacted using a roller (e.g., the roller 202 shown in FIG. 2).

SUMMARY

An exemplary embodiment of an attachment roller that is configured to attach to a vehicle includes a main body, a plurality of rolling members, and at least one attachment arm. The rolling members are attached to the main body such that the rolling members are able to rotate and move the attachment roller. The at least one attachment arm is attached to the main body and configured to attach to the vehicle. When the attachment roller is attached to the vehicle by the at least one attachment arm, the attachment roller has a path of travel that is not aligned on or within and is substantially parallel to a path of travel of the vehicle. The attachment roller may be configured to apply a pressure between about 30 psi and about 120 psi to a ground surface.

An exemplary methodology for compacting a paving material on a berm that is adjacent to a road includes attaching an attachment roller to a vehicle. The attachment roller includes a main body, a plurality of rolling members, and at least one attachment arm. The attachment roller is attached to the vehicle by the at least one attachment arm. The methodology also includes moving the vehicle on the road along a path of travel such that the attachment roller is moving on the berm along a second path of travel. The second path of travel of the attachment roller is not aligned on or within and is substantially parallel with the path of travel of the vehicle.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

Figure 1:
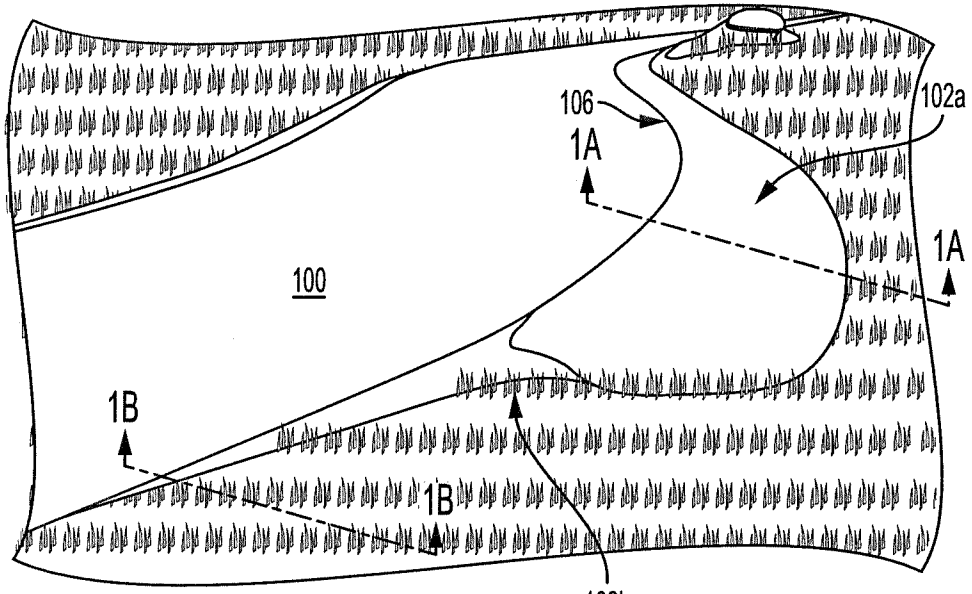
FIG. 1 is a perspective view of a road and a berm.
Figure 1B:
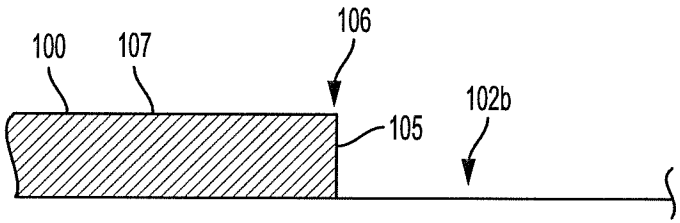
FIG. 1B is a cross-sectional vie of the road and berm of FIG. 1 taken along the lines 1B-1B of FIG. 1.
Figure 1A:
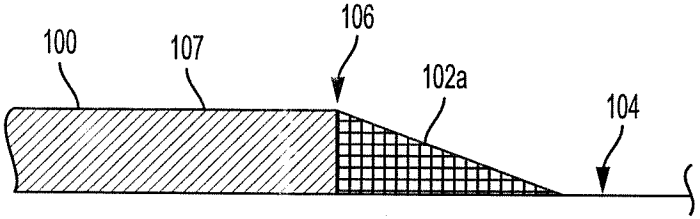
FIG. 1A is a cross-sectional vie of the road and berm of FIG. 1 taken along the lines 1A-1A of FIG. 1.

Certain problems may occur when a roller is compacting new material at the edge 106 of a road 100 or at the berm 102*a*, 102*b*. For example, as shown in FIG. 1A, if the berm 102*a* extends at a downward slope from the edge 106 of the road, the roller may need to take an angled position relative to a top surface 107 of the road 100 in order to adequately compact the berm 102*a*. In another example, as shown in FIG. 1B, if the berm 102*b* is not paved and there is a lip 105 at the edge 106 of the road 100, in order to compact the material at the edge of the road, a portion of the roller may need to extend over the lip. In yet another example, the ground surface 104 adjacent to the edge 106 of the road 100 or to the berm 102*a*, 102*b* may extend at a downward slope (e.g., a hill may be located next to the road or berm), and a portion of the roller may extend over this downward slope when the material is being compacted by the roller. In these examples, the extension of the roller over the edge 106 of the road 100 or the berm 102*a*, 102*b* may cause the roller to tip over, which is dangerous for workers that are operating the roller. In addition, in some circumstances, an object (e.g., a mailbox) may be located adjacent to a road 100 or berm 102*a*, 102*b*. The maneuverability of the roller and/or the line of vision of the worker operating the roller make it difficult to compact the material at the edge 106 of the road 100 or at the berm 102*a*, 102*b* without contacting the object, which can lead to damage of property. That is, a roller (e.g., the roller 202 shown in FIG. 2), because of its heavy weight, is often difficult to maneuver around objects. In addition, because the roller has a large front section, the line of vision of a worker operating the roller is often blocked by the large front section of the roller. The maneuverability of the roller and the blocked line of vision of the worker may lead to property adjacent to a road being damaged as the material at the edge of the road or the berm is being compacted.

The present application is directed to an attachment roller that is configured to prevent the above-mentioned problems from occurring. In particular, the present application is directed to an attachment roller that is configured to attach to a main roller (e.g., the roller 202 shown in FIG. 2) or any other suitable vehicle (e.g., a truck), such that the attachment roller (and not the main roller) is used to compact paving material at the edge 106 of the road 100 and the berm 102*a*, 102*b*. In certain embodiments, the main roller or other suitable vehicle that the attachment roller is connected to has a weight of at least 12,000 lbs. The attachment roller allows the main roller to be positioned away from the edge 106 of the road 100 or the berm 102*a*, 102*b*, such that the main roller does not extend over the edge of the road or the berm (i.e., the main roller remains on the road), which protects the main roller from tipping over and protects workers from the dangers that are involved when a main roller tips over. In addition, the attachment roller is able to be easily maneuvered around objects (e.g., mailboxes) that are adjacent to a road, as compared to the maneuverability of the main roller. In addition, the attachment roller provides a worker that is compacting the material at edge 106 of the road 100 and/or the berm 102*a*, 102*b* with a more clear sight line of the edge of the road and the berm, which prevents damage to property that is adjacent to the berm.

Figure 2A:
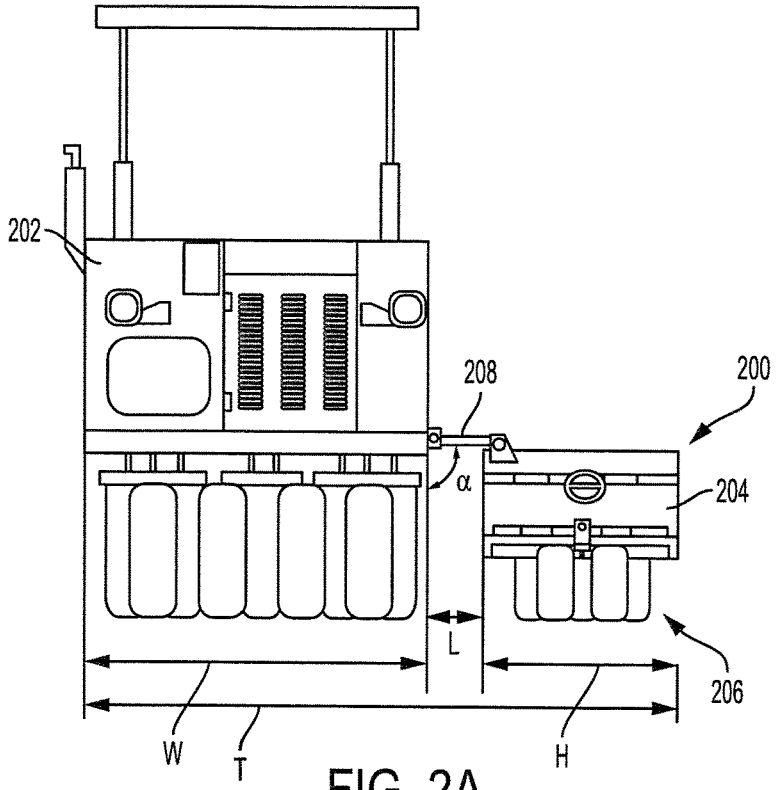
FIG. 2A is a front view of an exemplary embodiment of an attachment roller attached to a main roller.
Figure 2B:
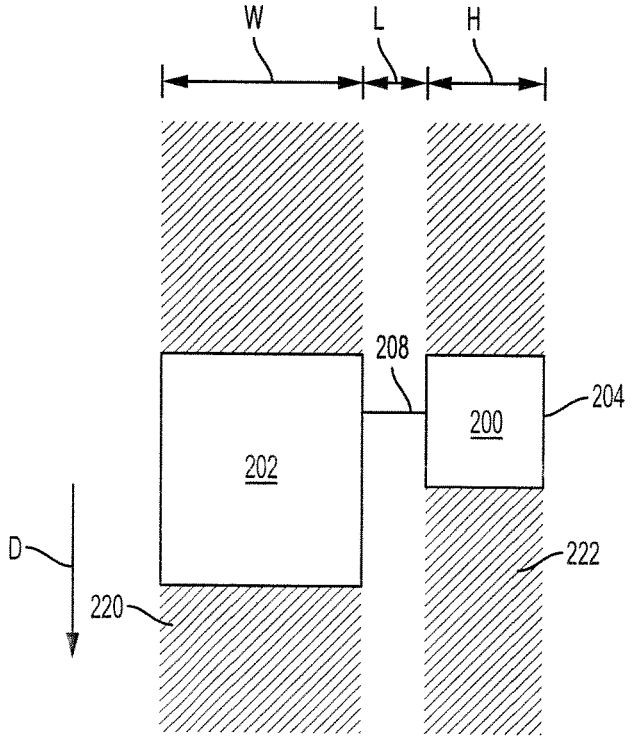
FIG. 2B is a top view of the exemplary attachment roller of FIG. 2A.

Referring to FIGS. 2A-2B, an exemplary attachment roller 200 is connected to a vehicle 202 (e.g., a roller, a truck, etc). The attachment roller 200 includes a main body 204, a plurality of rolling members 206, and at least one attachment arm 208. The attachment roller 200 is connected to a vehicle 202 in a manner that allows the attachment roller to follow a path of travel that is not aligned on or within and is substantially parallel with the path of travel of the vehicle. The term "path of travel" refers to the series of continuous positions a vehicle (e.g., the roller 202 or the attachment roller 200) takes in the process of moving from a one location to another location. For example, referring to FIG. 2B, the path of travel 220 of the vehicle 202 is defined by the width W of the vehicle and the direction D in which the vehicle is travelling. Similarly, still referring to FIG. 2B, the path of travel 222 of the attachment roller 200 is defined by the width H of the attachment roller and the direction D in which the attachment roller is travelling. Because the attachment roller 200 moves in substantially the same direction as the vehicle 202, the path of travel of the attachment roller is substantially parallel to the path of travel of the vehicle 202. In addition, because the attachment roller 202 is connected to the vehicle 200 by at least one attachment arm 208 such that the attachment roller is a distance L away from the vehicle, and because the path of travel of the attachment roller is substantially parallel to the path of travel of the vehicle, the path of travel of the attachment roller is not aligned on or within the path of travel of the vehicle. In certain embodiments, the distance L may be about 0 inches such that the attachment roller 200 is adjacent to the vehicle 202.

The path of travel of the vehicle system (i.e., the combination of the vehicle 202 and the attachment roller 200) is defined by the width T (i.e., the combination of distances W, L and H) and the direction in which the vehicle system is travelling. In certain embodiments, the width H of the attachment roller 200 is between about ⅛ and ⅖ of the width T of the vehicle system. In one embodiment, the width H of the attachment roller 202 is about ⅓ of the width T of the vehicle system. In various embodiments, the combination of the width W of the vehicle 202 and the width H of the attachment roller 200 is ⅘ or more of the width T of the vehicle system, such as about 9/10 or more. In some embodiments, the length L between the attachment roller 200 and the vehicle 202 is about 0 inches such that the attachment roller is adjacent to the vehicle, and, in these embodiments, the combination of the width W of the vehicle 202 and the width H of the attachment roller 200 is substantially 100 percent of the width T of the vehicle system.

The attachment roller 200 is configured to adequately compact a new paving material (e.g., asphalt, recycled asphalt, berm aggregate, or any other suitable material for covering a road or berm) on a road or berm in order to create a substantially level road surface. In order to compact the new paving material, the attachment roller 200 is made using heavy material. For example, the attachment roller 200 may have a weight of at least 3,000 lbs. In alternative embodiments, the attachment roller 200 may have a weight between about 3,000 lbs and about 8,000 lbs. The attachment roller 200, for example, may apply a pressure of between about 30 psi and about 120 psi to the ground surface in order to adequately compact the new paving material and create a substantially level surface, such as between about 45 psi and about 90 psi, such as about 62.5 psi. In another example, the attachment roller 200 may apply a pressure of 30 psi or greater, such as 45 psi or greater, such as 60 psi or greater, such as 75 psi or greater, such as 90 psi or greater, such as 120 psi or greater. The attachment roller 200 can be, for example, a pneumatic roller, a steel-wheeled roller, a vibratory roller, or any other suitable type of roller.

In certain embodiments, the main body 204 is configured to be made of a heavy material. That is, because the attachment roller 200 is used to adequately compact a new paving material on a road or berm, making the main body 204 include a heavy material will allow the attachment roller to sufficiently compact the new material to create a substantially level surface. In an exemplary embodiment, the main body 204 is made of steel, such as, for example, steel having a thickness of between about 2 inches and about 3 inches. In other embodiments, the steel may have a thickness of less than 2 inches or greater than 3 inches. In alternative embodiments, the main body 204 may be made of any other suitable rigid material that is capable of compacting new paving material on a road and berm and supporting the rolling members 206 and the attachment arms 208. In certain embodiments, one or more weights may be disposed on the main body 204 to make the attachment roller heavier.

The plurality of rolling members 206 are attached to the main body 204 by one or more members (e.g., one or more axles) that allows the rolling members to rotate and move the attachment roller 200. The rolling members 206 are configured to move the attachment roller 200 and compact a paving material (e.g., asphalt, berm aggregate, etc.) to a substantially level surface. That is, the rolling members 206 often are made of heavier materials so that the force applied by the rolling members on the paving material is sufficient to adequately compact the paving material and create a substantially level surface. A rolling member 206 may, for example, be a foam filled tire, an air-filled tire, a rubber tire, or the like. In certain embodiments, a rolling member 206 may have a width of about 15 inches. In some embodiments, a rolling member 206 may have a width of less than about 15 inches or greater than about 15 inches.

The one or more attachment arms 208 are configured to connect the attachment roller 200 to the vehicle 202. In certain embodiments, the attachment arms 208 are connected to the main body 204 of the attachment roller 200. In alternative embodiments, the attachment arms 208 may be attached to another portion of the attachment roller 200. In certain embodiments, the attachment arms 208 are pivotally connected to the attachment roller 200 and configured to be pivotally connected to the vehicle 202. The pivotal connection allows the angle $\alpha$ between the vehicle 202 and the attachment arms 208 to adjust based on the level of the ground surface on which the attachment roller is traveling relative to the level of the surface on which the vehicle is traveling. That is, the berm may have a sloped surface relative to the surface of the road, and the attachment roller 200 may be traveling on the berm, and the vehicle 202 may be traveling on the road. In these situations, the pivotal connection between the attachment roller 200 and the vehicle 202 allows the attachment roller to travel on surfaces having levels that are different than the level of the road. In certain embodiments, the pivotal connection between the attachment roller 200 and the vehicle 202 is configured such that the angle $\alpha$ is movable between about 20 degrees and about 130 degrees. In another embodiment, the angle $\alpha$ may be movable between about 45 degrees and about 135 degrees. In yet another embodiment, the angle $\alpha$ may be movable between about 60 degrees and about 120 degrees. The attachment arms 208 are configured to keep the attachment roller 200 connected to the vehicle 202 and to allow the attachment roller to be positioned to adequately compact paving material along a path of travel that is substantially parallel to the path of travel of the vehicle 202. When the attachment roller 200 is attached to the vehicle 202 by the attachment arms 208, the attachment roller is a distance L away from the vehicle 202. In certain embodiments, the distance L is between about 14 inches and about 18 inches. In alternative embodiments, the distance L may be less than 14 inches or more than 18 inches. The attachment arms 208 may be made of, for example, steel or any other suitable rigid material that is capable of securing the attachment roller 200 to a vehicle 202. In the illustrated embodiment, the attachment roller 200 includes one attachment arm 208. In alternative embodiments, the attachment roller 200 may include two attachment arms, three attachment arms, etc.

Figure 3:
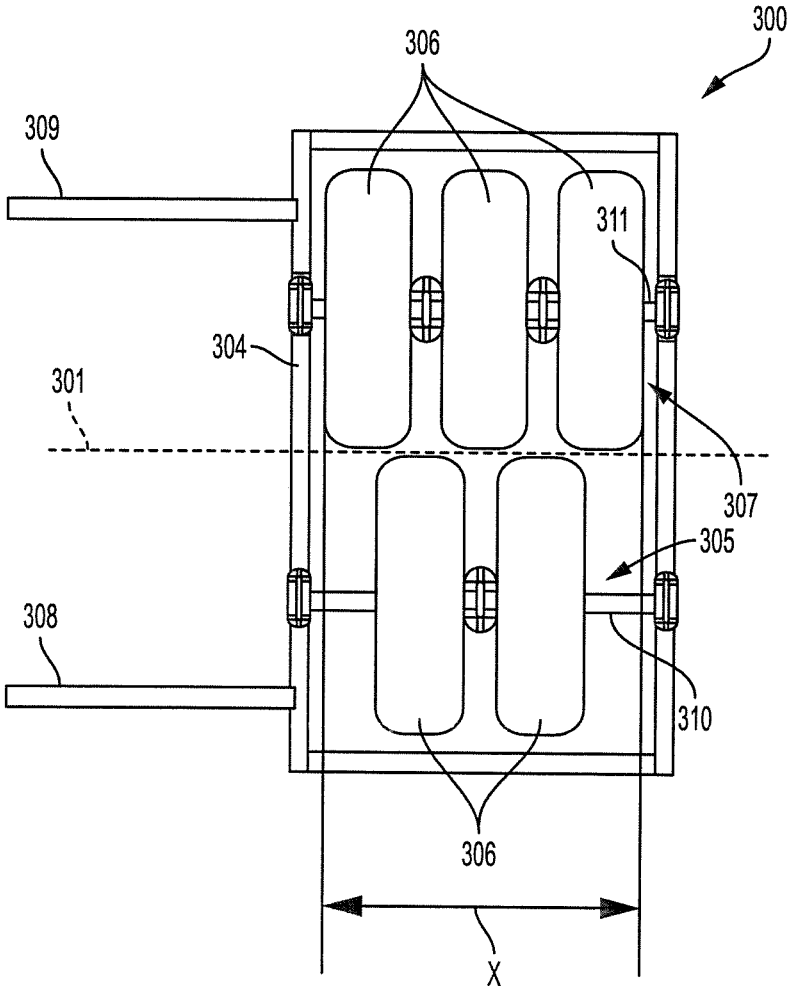
FIG. 3 is a top cross-sectional view of another exemplary embodiment of an attachment roller.

Referring to FIG. 3, another embodiment of an attachment roller 300 includes a main body 304, a first attachment arm 308, a second attachment arm 309, a first set 305 of rolling members 306, and a second set 307 of rolling members 306. The main body 304, the attachment arms 308, 309, and the rolling members 306 may take any suitable form, such as, for example, any form described in the present application. In the illustrated embodiment, the first set 305 of rolling members 306 is attached to a first member 310 (e.g., an axle), and the second set 307 of rolling members 306 is attached to a second member 311 (e.g., an axle), such that the rolling members 306 are able to rotate and move the attachment roller 300. Both the first member 310 and the second member 311 are also attached to the main body 304. In alternative embodiments, the attachment roller 300 may have one set of rolling members 306 or 3 or more sets of rolling members 306. In these embodiments, each set of rolling members can have its own axle that attaches the rolling members to the main body 304. In certain embodiments, the attachment roller 300 is attached to a vehicle such that the center of the attachment roller (which is aligned on the axis 301) is aligned with the drive wheels of the vehicle. That is, if the attachment roller 300 is attached to a vehicle having rear wheel drive, the center of the attachment roller 300 is aligned with the rear wheels 415 of the vehicle. The attachment roller 300 is aligned with the drive wheels of the vehicle to better control the turning of the attachment roller, which allows a user to better maneuver the attachment roller around objects (e.g., mailboxes) that are adjacent to a road.

The attachment roller 300 is configured such that the first set 305 and second set 307 of rolling members 306 cover a distance X. That is, the first set 305 and second set 307 of rolling members 306 are aligned such that at least one rolling members contacts every portion of a ground surface (in order to adequately compact paving material) over the distance X. In certain embodiments, rolling members 306 of the second set 307 are positioned to travel on a path that overlaps the path in which the rolling members of the first set 305 travel to ensure that the entire distance X is covered by the rolling members. Both the first set 305 and the second set 307 of rolling members 306 may include any suitable number of rolling members that are capable of adequately compacting paving material over the distance X. In addition, the first set 305 and the second set 307 may include the same amount of rolling members or a different amount of rolling members. The first set 305 of rolling members 306 may include two rolling members, three rolling members, four rolling members, etc. The second set 307 of rolling members 306 may include two rolling members, three rolling members, four rolling members, etc. In the illustrated embodiment, the first set 305 of rolling members 306 includes two rolling members and the second set 307 of rolling members 306 includes three rolling members, and the rolling members of the first set are offset from the rolling members of the second set in order to cover the entire distance X. In the illustrated embodiment, the second set 307 of rolling members 306 has one more rolling member than the first set 305 of rolling members. In alternative embodiments, the first set 305 and second set 307 of rolling members 306 may include the same number of rolling members, or the first set may have more rolling members than the second set. Referring to FIG. 3, an attachment roller 300 with at least two axles (e.g., the first member 310 and the second member 311), in which each axle has two or more rolling members 306 attached thereto, allows the attachment roller to travel over uneven surfaces more easily, and helps prevent the attachment roller from tipping over.

Figure 4:
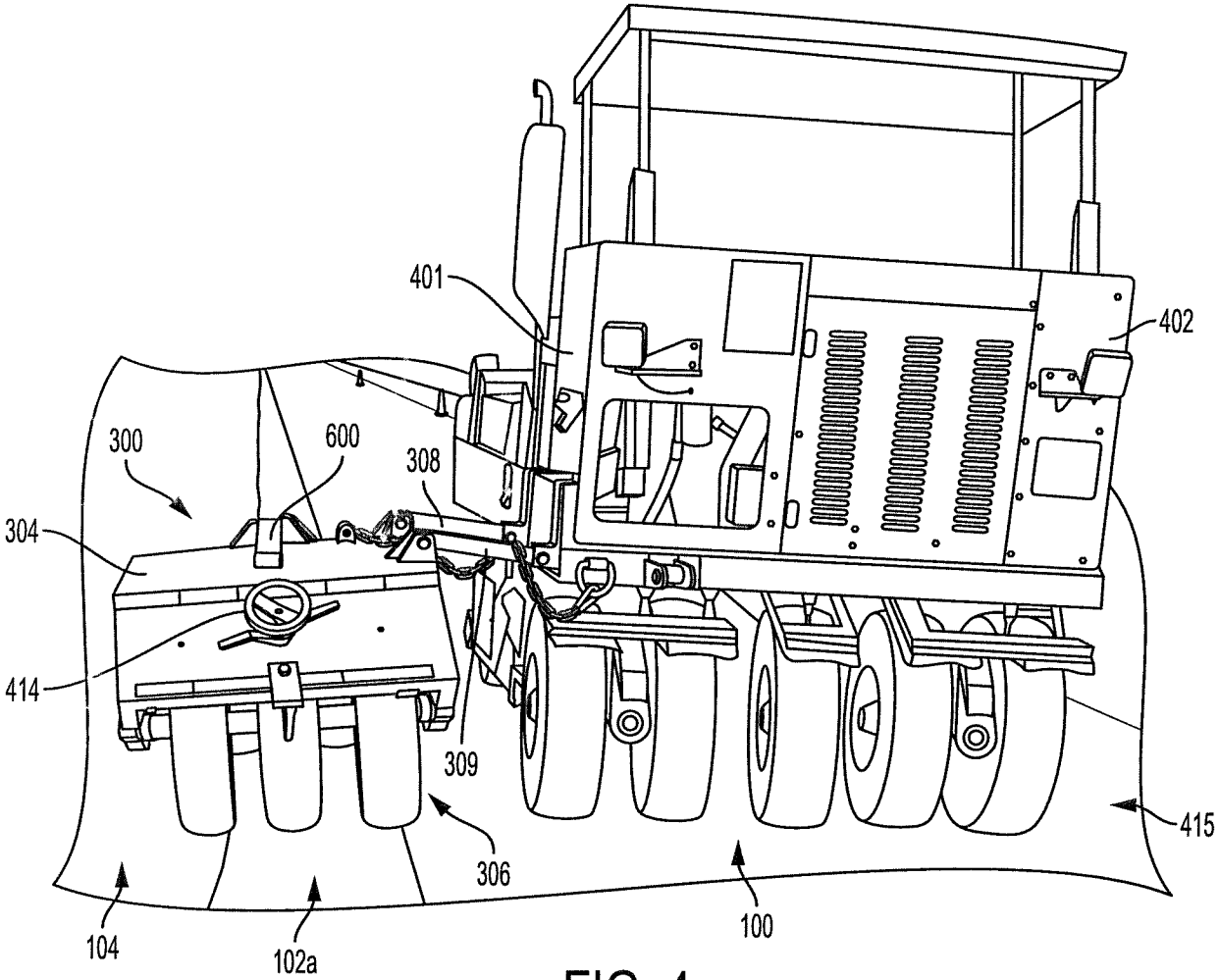
FIG. 4 is a rear perspective view of the exemplary embodiment of the attachment roller of FIG. 3, in which the attachment roller is attached to a main roller, and the attachment roller is compacting paving material on the berm of a road.
Figure 5:
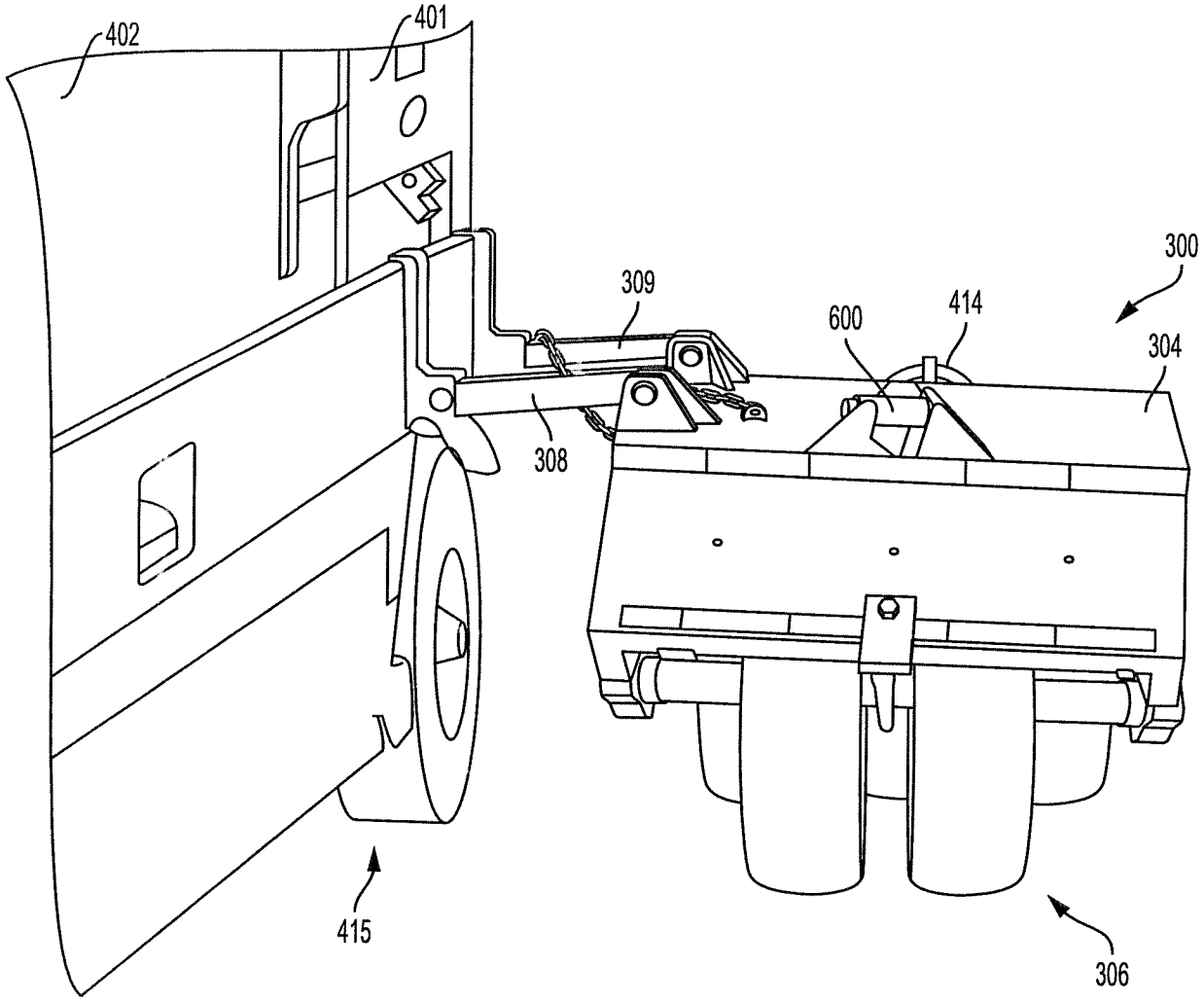
FIG. 5 is a perspective view of the connection between the exemplary embodiment of the attachment roller of FIG. 3 and a main roller.

Referring to FIGS. 4-5, the attachment roller 300 is attached to a vehicle 402. In the illustrated embodiment, the attachment roller 300 is connected to a side 401 of the vehicle 402, such that the center of the attachment roller is centered on the rear drive wheels of the vehicle. The center of the attachment roller 300 is aligned with the rear drive wheels 415 of the vehicle to better control the turning of the attachment roller, which allows a user to better maneuver the attachment roller around objects (e.g., mailboxes) that are adjacent to a road. The attachment roller 300 is connected to a vehicle 402 in a manner that allows the attachment roller to follow a path of travel that is not aligned on or within and is substantially parallel with the path of travel of the vehicle.

Referring to FIG. 4, the attachment roller 300 is attached to the vehicle 402 such that, when the vehicle is compacting pavement on the road 100, the attachment roller can be used to compact pavement on the berm 102*a*. In the illustrated example, the attachment roller 300 is extending past the berm 102*a* and onto the ground surface 104. As noted above, the road 100, the berm 102*a*, and the ground surface 104 may have varying levels. In these circumstances, it is advantageous to compact the pavement on the berm 102*a* with an attachment roller 300 rather than a roller 402 because of the dangers mentioned above with regards to having the roller 402 on uneven surfaces. In addition, because the attachment arms 308, 309 pivotally connect the attachment roller 300 to the main roller 402, the attachment roller can maneuver the uneven surfaces to adequately compact pavement of the berm 102*a*. Still referring to FIG. 4, the attachment roller 300 may include a brake member 414 that is configured to prevent the attachment roller from moving or being moved when the attachment roller is not in use. In certain embodiments, the brake member may be configured to add a friction force to one or more of the rolling members 306. In the illustrated embodiment, the brake member 414 is a hand wheel that tightens a locking member (not shown) when the hand wheel is turned in one of a clockwise or counterclockwise direction. In other embodiments, the brake member 414 may be, for example, a hand lever having a locking member or any other suitable brake member that is capable of preventing the attachment roller from moving when the attachment roller is not in use.

Figure 6:
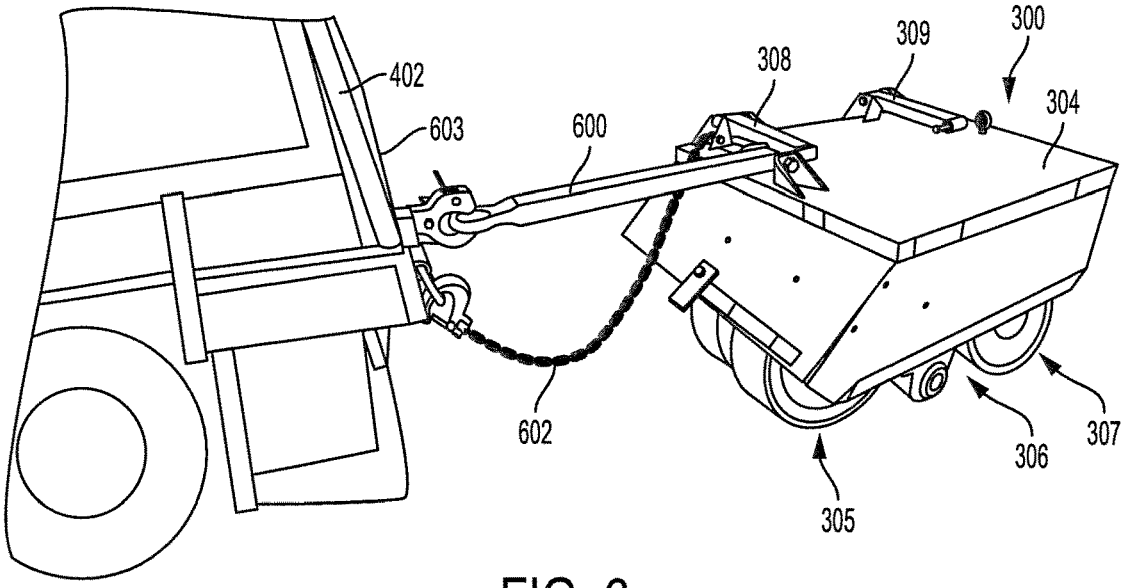
FIG. 6 is a side perspective view of the exemplary embodiment of the attachment roller of FIG. 3 being towed by a main roller.
Figure 7:
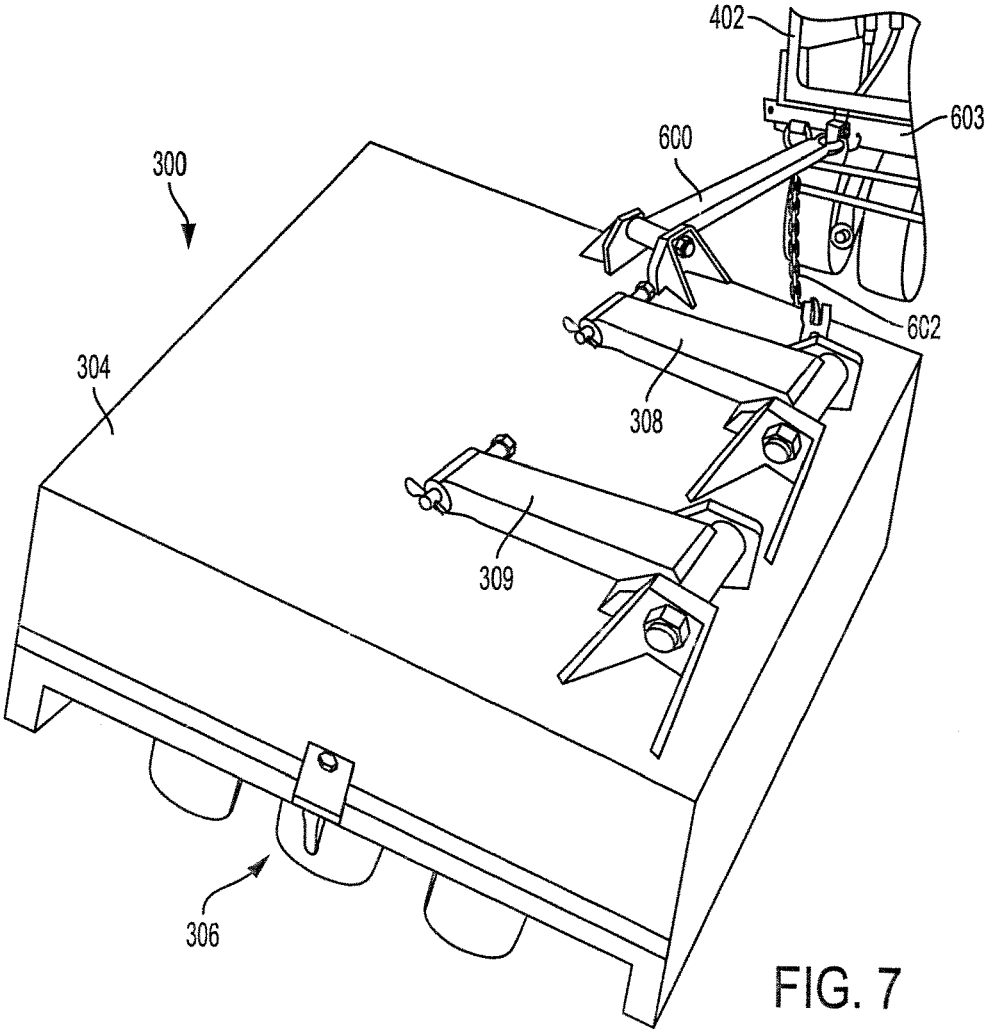
FIG. 7 is a rear perspective view of the exemplary embodiment of the attachment roller of FIG. 3 being towed by a main roller.

Referring to FIGS. 6-7, in certain embodiments, the attachment roller 300 is configured to be towed by a vehicle (e.g., a roller, a truck, etc.), such that the attachment roller can be transported to and from a job site. In the illustrated embodiment, the attachment roller comprises a towing attachment arm 600 that is configured to be removably attached to the rear 603 of the roller 402. When the towing attachment arm 600 is attached to the rear 603 of the roller 402, the attachment roller is in a towing position, which allows the attachment roller to follow the path of travel of the roller 402. In alternative embodiments, the attachment roller 300 includes a trailer hitch that is configured to attach to the hitch of a vehicle for transportation of the attachment roller. In certain embodiments, the attachment roller is also secured to the roller 402 by a securing member 602 (e.g., a chain link). The securing member 602 can be used to secure the attachment roller 300 to the roller 402 when the attachment roller is in the towing position (as shown in FIGS. 6-7) and when the attachment roller is in a working position (as shown in FIGS. 4-5). In certain embodiments, when the attachment roller 300 is in the towing position, the attachment arms 308, 309 are pivoted about their connection points such that the attachment arms are disposed on the top surface of the main body 304 of the attachment roller. Similarly, referring to FIGS. 4-5, when the attachment roller 300 is in the working position, the towing attachment arm 600 is pivoted about its connection point such that the towing attachment arm is disposed on the top surface of the main body 304 of the attachment roller.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

The invention claimed is:

1. An attachment roller that is configured to attach to a vehicle and compact paving material, the attachment roller comprising:

a main body;

at least one attachment arm attached to the main body, wherein the attachment arm is configured to attach to the vehicle; and a plurality of rolling members attached to the main body such that movement of the vehicle causes the rolling members to rotate and move the attachment roller when the attachment roller is attached to the vehicle;

wherein, when the attachment roller is attached to the vehicle by the at least one attachment arm, the attachment roller has a path of travel that is not aligned on or within and is substantially parallel to a path of travel of the vehicle;

wherein a center of the attachment roller is in a fixed alignment with a drive axle of the vehicle with respect to the path of travel of the vehicle when the attachment roller is attached to the vehicle by the at least one attachment arm;

wherein the attachment roller is configured to apply a pressure between about 30 psi and about 120 psi to a ground surface to compact paving material.

2. The attachment roller according to claim 1, wherein the attachment roller comprises two attachment arms that are configured to be pivotally connected to the vehicle such that the attachment roller can pivot between a substantially level position and an inclined position that allows the attachment roller to compact paving material on an inclined surface.

3. The attachment roller according to claim 1, wherein the attachment roller weighs between about 3,000 lbs and about 5,000 lbs.

4. The attachment roller according to claim 1, wherein the rolling members comprise a foam filled tire.

5. The attachment roller according to claim 1, wherein the attachment roller is a pneumatic roller.

6. The attachment roller according to claim 1, further comprising a towing attachment arm attached to the main body, wherein when the attachment roller is attached to the vehicle by the towing attachment arm, the attachment roller has a path of travel that is aligned on a path of travel of the vehicle.

7. The attachment roller according to claim 1, further comprising a brake member that is capable of locking one or more of the rolling members in order to prevent the locked rolling member from rotating.

8. The attachment roller according to claim 1, wherein the plurality of rolling members comprises a first set of rolling members and a second set of rolling members, wherein the first set of rolling member are disposed in front of the second set of rolling members, and wherein the rolling members of the first set are offset from the rolling members of the second set.

9. The attachment roller according to claim 8, wherein the first set of rolling members has two rolling members, and wherein the second set of rolling members has three rolling members.

10. A vehicle for compacting paving material, the vehicle comprising:

a main roller for compacting paving material on a first path of travel; and an attachment roller removably attached to the main roller, wherein the attachment roller is configured to compact paving material on a second path of travel that is not aligned on or within and is substantially parallel to the first path of travel when the attachment roller is attached to the main roller, and wherein the attachment roller comprises:

a main body;

a plurality of rolling members attached to the main body such that movement of the main roller causes the rolling members to rotate and move the attachment roller; and at least one arm pivotably attached to the main body, wherein the at least one attachment arm is removably and pivotably attached to the main roller such that the attachment roller can pivot between a substantially level position and an inclined position that allows the attachment roller to compact paving material on an inclined surface;

wherein, when the attachment roller is attached to the main roller, a center of the attachment roller is in a fixed alignment with a drive axle of the main roller with respect to the first path of travel of the main roller;

wherein the attachment roller is configured to apply a pressure between about 30 psi and about 120 psi to a ground surface to compact paving material on the berm.

11. The vehicle according to claim 10, wherein a width defining the path of travel of the attachment roller is between about ⅛ and about ⅖ of the width defining the path of travel of the vehicle.

12. The vehicle according to claim 10, wherein a combination of a width defining the path of travel of the attachment roller and a width defining the path of travel of the main roller is ⅘ or greater of the width defining the path of travel of the vehicle.

13. The vehicle according to claim 10, wherein the plurality of rolling members of the attachment roller comprises a first set of rolling members and a second set of rolling members, and wherein the first set of rolling members are disposed in front of the second set of rolling members, and wherein the first set of rolling members are offset from the second set of rolling members.

14. The vehicle according to claim 10, wherein a center of the attachment roller is aligned with rear wheels of the vehicle when the attachment roller is attached to the main roller by the at least one attachment arm.

15. The vehicle according to claim 10, wherein the main roller has a weight of at least 12,000 lbs.

16. The vehicle according to claim 10, wherein the attachment roller is attached to the main roller such that the attachment roller is positioned compact material on a berm when the main roller is compacting material on a road.

17. A method for compacting a paving material on a first path of travel and a second path of travel, the method comprising:

attaching an attachment roller to a vehicle, the attachment roller comprising a main body, a plurality of rolling members, and at least one attachment arm, wherein the attachment roller is attached to the vehicle by the attachment arm, wherein a center of the attachment roller is in a fixed alignment with a drive axle of the vehicle with respect to the first and second paths of travel; and moving the vehicle along the first path of travel such that the plurality of rolling members of the attachment roller rotate to move the attachment roller along the second path of travel, wherein the vehicle compacts paving material on the first path of travel and the attachment roller compact material on the second path of travel, wherein the second path of travel is not aligned on or within and is substantially parallel to the path of travel of the vehicle.

18. The method according to claim 17, further comprising the step of applying a pressure between about 30 psi and about 120 psi to the berm with the attachment roller.

19. The method according to claim 17, wherein the first path of travel is a road and the second path of travel is a berm that is adjacent to the road.

20. The method according to claim 17, further comprising:

detaching the attachment roller from the vehicle; and attaching the attachment roller to the a rear of the vehicle such that the center of the attachment roller is not aligned with the drive axle of the vehicle, and such that moving the vehicle along the first path of travel causes the plurality of rolling members of the attachment roller to rotate and move the attachment roller along the first path of travel.

* * * * *